US010969195B1

(12) United States Patent
Clark

(10) Patent No.: US 10,969,195 B1
(45) Date of Patent: Apr. 6, 2021

(54) TRANSLUCENT REFLECTIVE HAND GUN FRONT SIGHT

(71) Applicant: Clinton J. Clark, Plainwell, MI (US)

(72) Inventor: Clinton J. Clark, Plainwell, MI (US)

( * ) Notice: Subject to any disclaimer, the term of this patent is extended or adjusted under 35 U.S.C. 154(b) by 0 days.

(21) Appl. No.: 17/070,591

(22) Filed: Oct. 14, 2020

(51) Int. Cl.
*F41G 1/02* (2006.01)

(52) U.S. Cl.
CPC ..... *F41G 1/02* (2013.01)

(58) Field of Classification Search
CPC ..... F41G 1/42; F41G 1/01; F41G 1/02; F41G 1/027; F41G 1/033
USPC ..... 42/144
See application file for complete search history.

(56) References Cited

U.S. PATENT DOCUMENTS

| | | | | |
|---|---|---|---|---|
| 2,610,405 | A | 9/1952 | Dickinson | |
| 4,918,823 | A | 4/1990 | Santiago | |
| 5,887,352 | A * | 3/1999 | Kim | F41G 1/01 42/144 |
| 6,233,836 | B1 | 5/2001 | Uhlmann et al. | |
| 6,360,471 | B1 | 3/2002 | Stein | |
| 7,946,075 | B2 | 5/2011 | Nasef | |
| 2016/0349009 | A1 | 12/2016 | Nasef | |

FOREIGN PATENT DOCUMENTS

| | | | | |
|---|---|---|---|---|
| CN | 2798028 | Y | 10/2005 | |
| DE | 29503878 | U1 * | 4/1995 | F41G 1/02 |
| GB | 189913890 | A | 8/1899 | |

OTHER PUBLICATIONS

Strike Industries Modular Blade Sight Set Glock, Source: https://www.midwayusa.com/product/1021539826, 8 pages.
Ruger Front Sights for Redhawk Package of Four Sold, Source: https://guide.alibaba.com/shop/ruger-front-sights-for-redhawk-package-of-four-sold_1000070017.html, 2 pages.
A00301 Marlin 60, 70, 795, 980, 981, and XT-22 front sight insert (orange), Source: https://www.darwuss.com/index.php?main_page=product_info&products_id=300501, 3 pages.
Original Marlin 883N 45 9 Fluorescent Orange Front Ramp Sight Insert, Source: https://www.ebay.com/itm/Original-Marlin-883N-45-9-Fluorescent-Orange-Front-Ramp-Sight-Insert-/220970345301. 2 pages.

(Continued)

*Primary Examiner* — Reginald S Tillman, Jr.
(74) *Attorney, Agent, or Firm* — Taft Stettinius & Hollister LLP; Gerald E. Helget

(57) ABSTRACT

A translucent reflective hand gun front sight includes a rectangular top portion of acrylic, polycarbonate or other suitable plastic having a vertical rear wall, a vertical front wall, a reflective horizontal top wall, a top front wall radiused transition portion forming an internal rectangular solid sight bead to be placed on the target when viewed through the vertical rear wall. The rectangular portion also includes a vertical reflective right side wall and a vertical reflective left side wall. Below the side walls are reflective right and left side shoulders extending outwardly and downwardly from the side walls transitioning into reflective lower vertical side portions extending vertically and downward from the shoulders. A lower most mounting base to affix the front sight to the gun is also provided.

12 Claims, 4 Drawing Sheets

(56) References Cited

OTHER PUBLICATIONS

Dark Diamond Sight for Beretta PX4 Storm, Source: https://advantagetactical.com/product/dark-diamond-sight-for-beretta-px4-storm/, 3 pages.
STI Staccato 3.9" Fixed Charger Sight Set-Tritium Rear & Tritium Front, Source: https://dawsonprecision.com/sti-staccato-3-9-fixed-charger-sight-set-tritium-rear-tritium-front/, 4 pages.
STI Staccato 3.9" Fixed Charger Sight Set-Black Rear & Optic Front, Source: https://dawsonprecision.com/sti-staccato-3-9-fixed-charger-sight-set-black-rear-optic-front/, 4 pages.

* cited by examiner

TRANSLUCENT REFLECTIVE HAND GUN FRONT SIGHT

FIELD OF INVENTION

The present invention relates generally to hand gun firearms, and more particularly to an improved hand gun front sight.

BACKGROUND OR THE INVENTION

It is well known that iron sights are used on firearms to assist the operator in aligning the firearm with the intended target. Typically this includes the alignment of the rear sight with the front sight and then the intended target.

Prior art FIGS. 1 and 2 illustrate iron sights 2 on the top of the slide of a semiautomatic handgun which also may be mounted on the frame and barrel of a hand gun revolver. The iron sights 2 generally comprise a front blade 4 and a rear sight 6. Rear sight 6 includes a top notch 8 wherein the front blade 4 is squarely aligned with the desired target 10 directly aligned in the background. The perfect alignment of the rear sight 6, the front sight 4 and the target 10 is often difficult to achieve for a novice. Poor lighting conditions also affect the operator in proper alignment.

As shown in FIG. 3, Fiber optic sights 12 have been invented to further assist the operator in perfect alignment of the gun sight 12. Typically fiber optic sights 12 include a front translucent, fluorescent or Tritium cylinder blade 14 which allows the operator to place the front sight 14 onto the target. Rear sight 16 also has a notch for placement of the front sight 14 squarely within the notch while aligned on the target. Rear sight 16 may also include fiber optics in the form of translucent, fluorescent or Tritium cylinders for alignment with the front sight 14.

There is a need for a simple translucent reflective hand gun front sight that quickly assists the operator in proper alignment of the gun sights onto the target which includes some reflectivity, translucency and absorbs light and glows in low light conditions to further assist the operator.

SUMMARY OF THE INVENTION

A translucent reflective hand gun front sight includes a rectangular top portion of acrylic, polycarbonate or other suitable plastic having a vertical rear wall, a vertical front wall, a reflective horizontal top wall, a top front wall radiused transition portion forming an internal rectangular solid sight bead to be placed on the target when viewed through the vertical rear wall. The rectangular portion also includes a vertical reflective right side wall and a vertical reflective left side wall. Below the side walls are reflective right and left side shoulders extending outwardly and downwardly from the side walls transitioning into reflective lower vertical side portions extending vertically and downward from the shoulders. A lower most mounting base to affix the front sight to the gun is also provided.

A principal object and advantage of the present invention is that it quickly assists the operator to quickly and accurately align the front sight onto the target by rotating the operator's wrist to eliminate any reflections off the front sight while the front sight is properly aligned within the notch of the rear sight.

Another principal object and advantage of the present invention is that the front sight with its radiused top front portion creates an internal rectangular solid sight bead to be placed on the target when viewed through the vertical rear wall.

Another principal object and advantage of the present invention is that the front sight is that it creates reflections when the front sight is not properly aligned on the target to facilitate wrist rotations to eliminate any and all reflections easily.

Another principal object and advantage of the present invention is that the front sight works well in low light conditions.

Another principal object and advantage of the present invention is that the front sight draws in light and brightens up substantially for ease of target acquisition.

Another principal object and advantage of the present invention is that the front sight has its front top radiused transition portion which allows the hand gun to be smoothly withdrawn from a holster without wearing, catching or breaking off the front sight with repeated usage.

Another principal object and advantage of the present invention is that the front sight provides multiple reflective surfaces including the top wall, side walls, shoulders and vertical lower side portions to aid the operator in quick and accurate alignment of the front sight in the rear sight notch and on the target.

DETAILED DESCRIPTION

Figure 1:
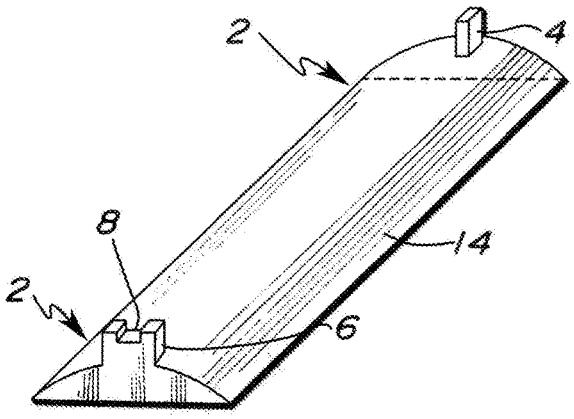
Fig.1 (PRIOR ART)
FIG. 1 is a prior art perspective view of a broken away top surface of a hand gun slide with iron sights.
Figure 2:
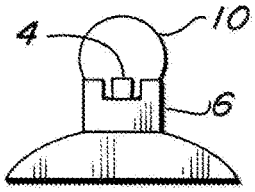
Fig.2 (PRIOR ART)
FIG. 2 is a prior art rear elevational view of the broken away top surface of a hand gun slide with iron sights and a target beyond of FIG. 1.
Figure 3:
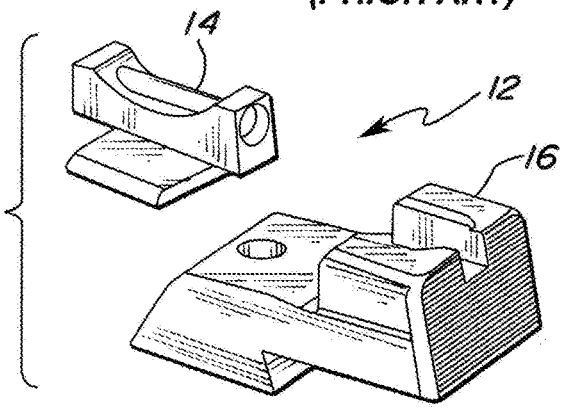
Fig.3 (PRIOR ART)
FIG. 3 is a prior art perspective view of a fiber optic gun front and rear sights.
Figure 4:
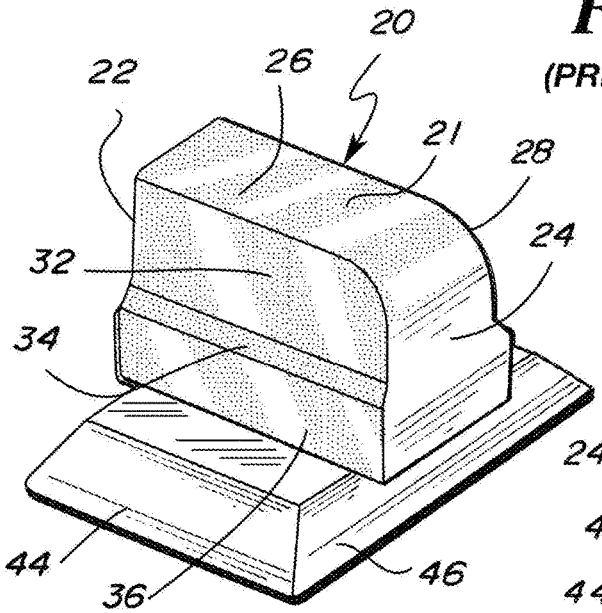
FIG. 4 is a right front perspective view of the translucent reflective hand gun front sight of the present invention.
Figure 5:
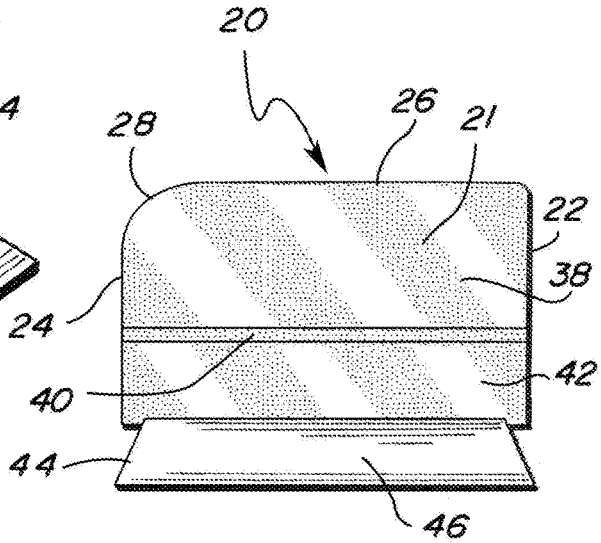
FIG. 5 is a left side elevational view of the translucent reflective hand gun front sight of the present invention.
Figure 6:
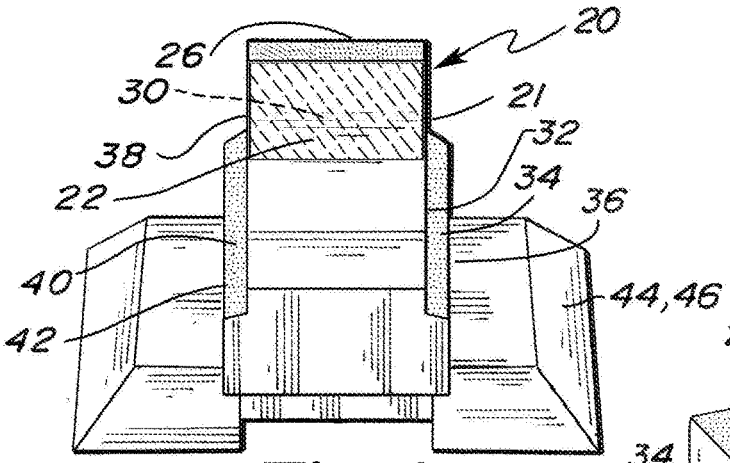
FIG. 6 is an upper rear elevational view of the translucent reflective hand gun front sight of the present invention.
Figure 7:
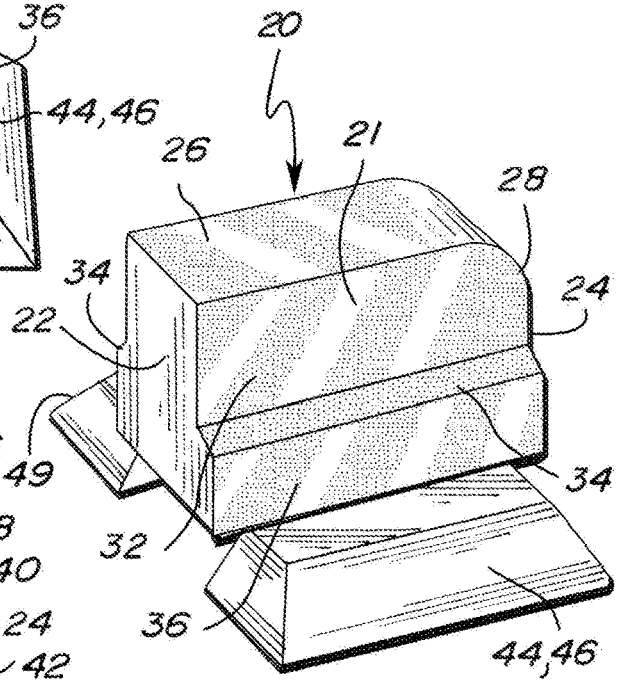
FIG. 7 is a rear right side perspective view of the translucent reflective hand gun front sight of the present invention.
Figure 8:
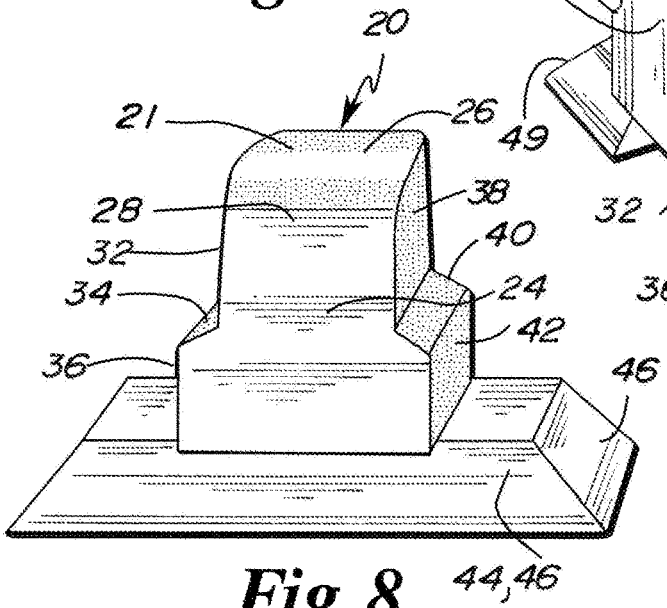
FIG. 8 is an upper front perspective view of the translucent reflective hand gun front sight of the present invention.

Referring to FIGS. 4-8, the translucent reflective hand gun front sight 20 of the present invention may be seen and described. The front sight is made out of acrylic, polycarbonate or other suitable translucent plastic like material. The hand gun front sight 20 includes a rectangular upper portion 21 with a vertical rear wall 22, a vertical front wall 24, a reflective (stippled) horizontal top wall 26 and a radiused transition portion 28 between the top and front walls 24 and 26 which creates a solid sight bead (diagonally dashed) 30 in the vertical front wall 24, specifically at the radiused portion 28, when viewed through the rear wall 22.

The rectangular upper portion 21 also has a reflective (stippled) vertical right side wall 32, a reflective (stippled) right side shoulder 34 extending outward and downward from the right side wall 32 and a reflective (stippled) lower vertical right side portion 36 extending vertical and downward from the right shoulder 34. On the left side of the rectangular portion 21 is a reflective (stippled) vertical left side wall 38, a reflective (stippled) left side shoulder 40 extending outward and downward from the left side wall 38 and a reflective (stippled) lower vertical left side portion 42 extending vertical and downward from the right shoulder 40. Below the rectangular upper portion 21 is located a mounting base 44 suitably with mounting tongues 46.

Figure 9:
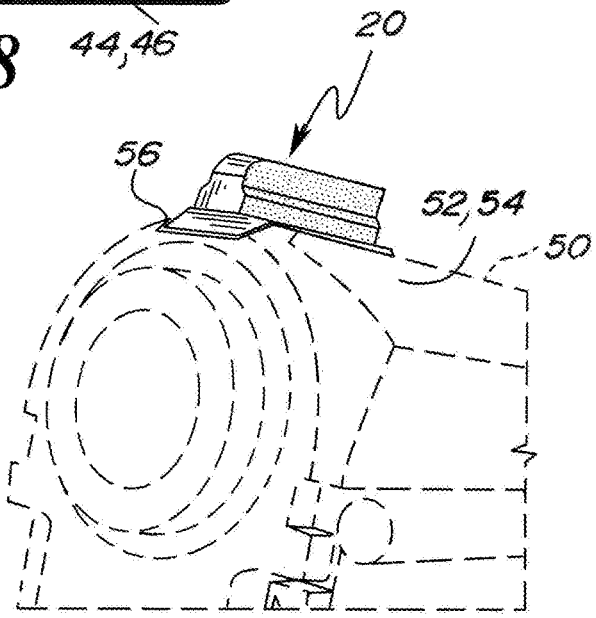
FIG. 9 is a front perspective view of a front slide broken away of a hand gun with the front sight of the invention mounted thereon.
Figure 10:
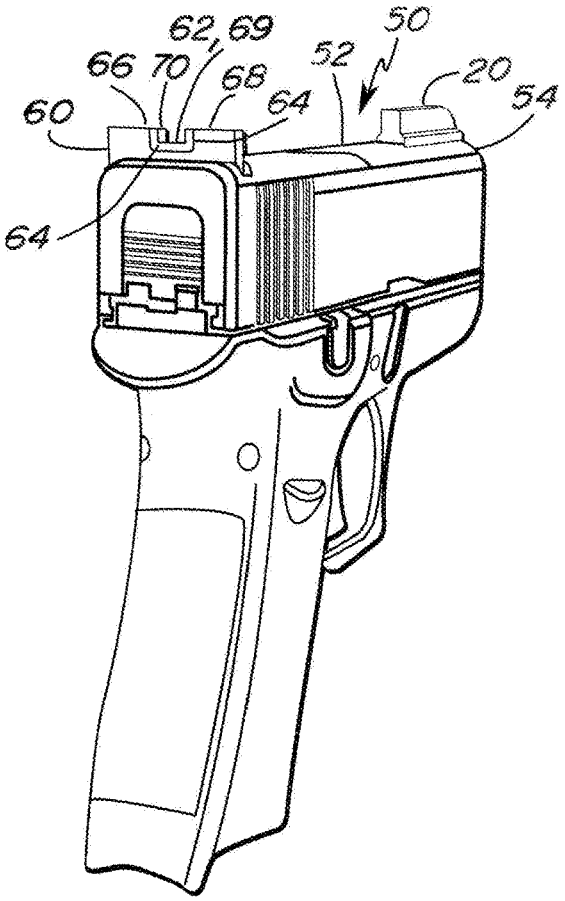
FIG. 10 is a rear perspective view of a hand gun with the front sight of the invention and a rear sight mounted thereon.
Figure 11:
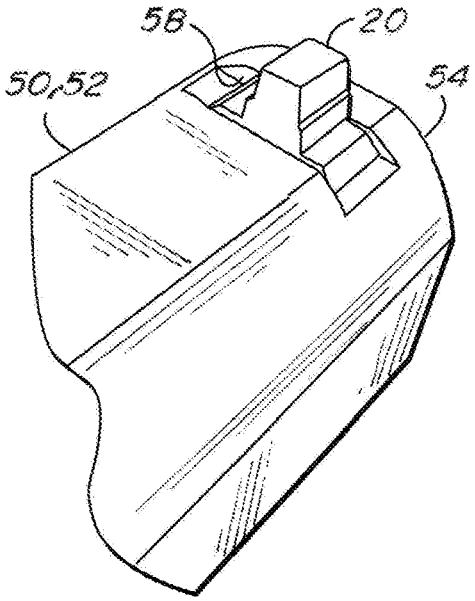
FIG. 11 is a rear perspective view of the slide or barrel front end broken away from a hand gun with the front sight mounted thereon.
Figure 12A:
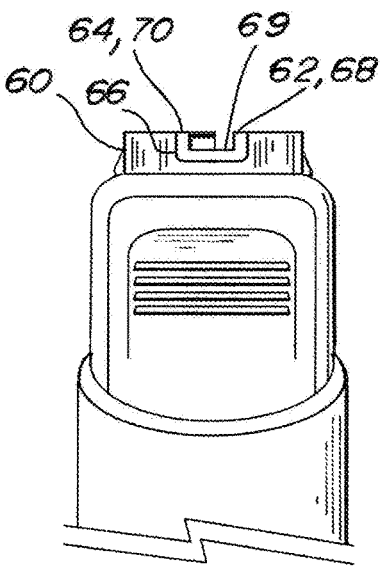
FIG. 12A is a rear elevational view of the hand gun slide broken away from the hand gun looking down the rear and front sights improperly aligned to the left.
Figure 13A:
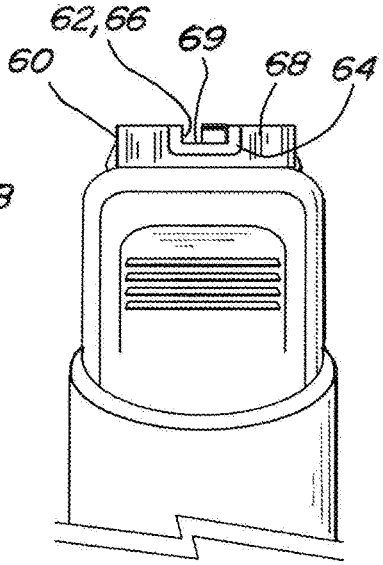
FIG. 13A is a rear elevational view of the hand gun slide broken away from the hand gun looking down the rear and front sights improperly aligned to the right.
Figure 14A:
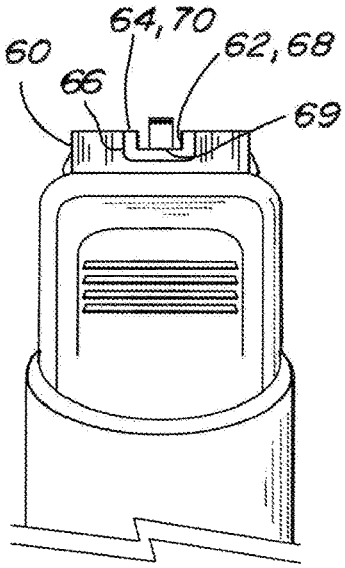
FIG. 14A is a rear elevational view of the hand gun slide broken away from the hand gun looking down the rear and front sights improperly aligned too high.
Figure 15A:
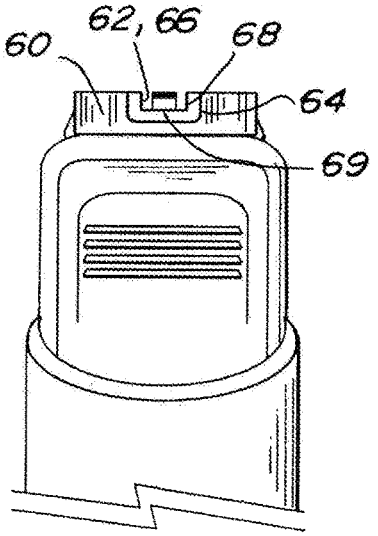
FIG. 15A is a rear elevational view of the hand gun slide broken away from the hand gun looking down the rear and front sights properly aligned with no reflections.
Figure 12B:
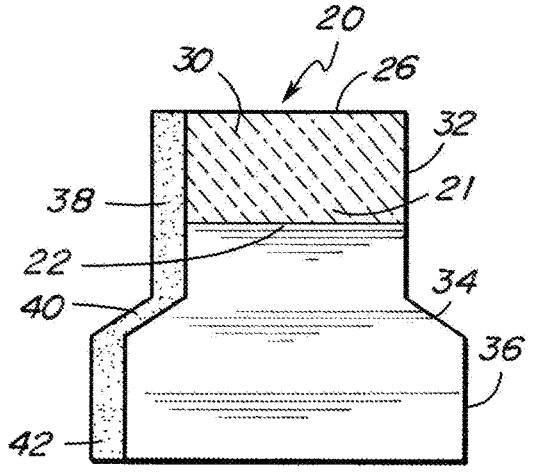
FIG. 12B is an enlarged rear elevational view of front sight improperly aligned to the left showing left side reflection.
Figure 13B:
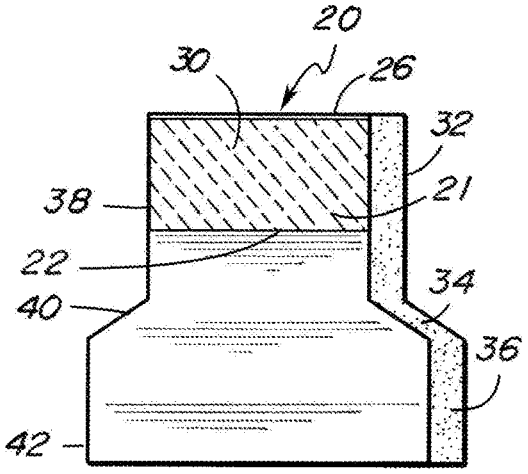
FIG. 13B is an enlarged rear elevational view of front sight improperly aligned to the right showing right side reflection.
Figure 14B:
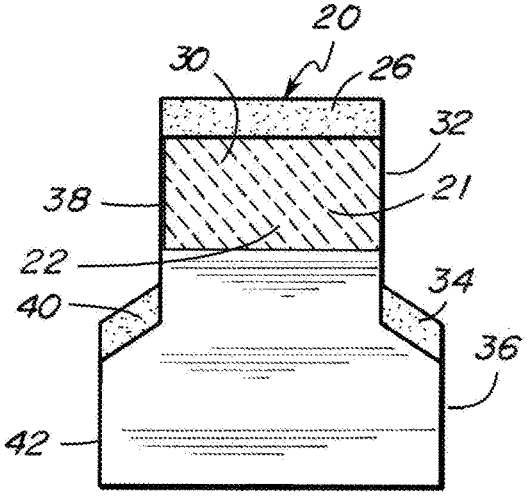
FIG. 14B is an enlarged rear elevational view of front sight improperly aligned too high showing top reflection.
Figure 15B:
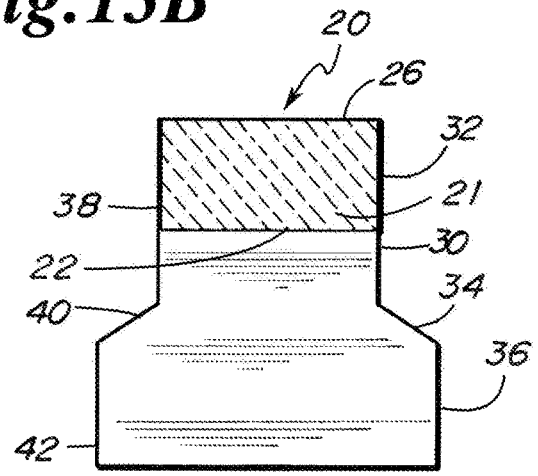
FIG. 15B is an enlarged rear elevational view of front sight properly aligned with no reflections.

Referring to FIGS. 9-11, the mounting of the hand gun front sight 20 may be seen and understood. A hand gun 50 suitably has a barrel or slide 52 with a front muzzle end 54. In a front portion of the slide 52 are located longitudinal grooves 56 wherein the mounting tongues 46 are slid into place and secured suitably with a set screw (not shown) from the underside of the slide 52. In FIG. 11 it is shown that the front sight 20 is mounted with its horizontal tongues 58 captured by grooves 58

In FIG. 10, an accompanying rear sight 60 is similarly positioned and secured to the rear end of the slide 52. The rear sight includes a centrally located 3-sided notch 62 with a white perimeter 64 marked therearound for ease of visibility. The notch 62 includes a left side 66, a right side 68, a bottom side 69 and a top portion 70. Front sight is shown to be mounted with left and right longitudinal tongues. There are a multitude of mounting options to a gun of the front sight 20 and rear sight 60 as is readily known to one skilled in the art.

Referring to FIGS. 12A-15A and FIGS. 12B-15B, the aiming operation of the front sight 20 in cooperation with rear sight 60 may be seen and understood. Specifically, in FIGS. 12A and 12B the front gun sight 20 is improperly aligned toward the left showing reflections (stippled) off the reflective vertical left side wall 38, left side shoulder 40 and lower left side portion 42. In this position the operator simply rotates or rolls his wrist slightly to the right and the reflections disappear. Specifically, in FIGS. 13A and 13B the front gun sight 20 is improperly aligned toward the right showing reflections (stippled) off the reflective vertical right side wall 32, left side shoulder 34 and lower left side portion 36. In this position the operator simply rotates or rolls his wrist slightly to the left and the reflections disappear. Specifically, in FIGS. 14A and 14B the front gun sight 20 is improperly aligned too high showing reflections (stippled) off the reflective horizontal top wall 26 and reflective left and right side shoulders 40 and 34. In this position the operator simply rotates or rolls his wrist slightly downward and the reflections disappear. Specifically in FIGS. 15A and 15B, the front gun sight 20 is properly aligned with no reflections off any surfaces with the solid sight bead (diagonally dashed) to be positioned on the target.

The accompanying FIGS. and above descriptions are for illustrative purposes. The true scope of the present invention is defined by the following claims.

What is claimed:

1. A translucent reflective hand gun front sight for aiming at a target, comprising:

a) a translucent rectangular top portion having a vertical rear wall, a vertical front wall, a reflective horizontal top wall, a top front wall radiused transition portion forming an internal rectangular solid sight bead within the rectangular top portion, adapted to be placed on the target when viewed through the vertical rear wall, a vertical reflective right side wall and a vertical reflective left side wall.

2. The translucent reflective hand gun sight of claim 1, further comprising a rear sight with a three sided notch for aligning the front sight therein.

3. The translucent reflective hand gun sight of claim 1, further comprising reflective right and left side shoulders extending outwardly and downwardly from the side walls transitioning into reflective lower vertical side portions extending vertically and downward from the shoulders.

4. The translucent reflective hand gun sight of claim 1, further comprising a lower most mounting base adapted to affix the front sight to the gun.

5. The translucent reflective hand gun sight of claim 1, where in the gun sight is made from acrylic or polycarbonate.

6. A translucent reflective hand gun front sight for aiming at a target, comprising:

a) a translucent rectangular top portion having a vertical rear wall, a vertical front wall, a reflective horizontal top wall, a top front wall radiused transition portion forming an internal rectangular solid sight bead within the rectangular top portion, adapted to be placed on the target when viewed through the vertical rear wall, a vertical reflective right side wall and a vertical reflective left side wall; and b) reflective right and left side shoulders extending outwardly and downwardly from the side walls transitioning into reflective lower vertical side portions extending vertically and downward from the shoulders.

7. The translucent reflective hand gun sight of claim 6, further comprising a rear sight with a three sided notch for aligning the front sight therein.

8. The translucent reflective hand gun sight of claim 6, further comprising a lower most mounting base adapted to affix the front sight to the gun.

9. The translucent reflective hand gun sight of claim 6, where in the gun sight is made from acrylic or polycarbonate.

10. A translucent reflective hand gun front sight for aiming at a target, comprising:

a) a translucent rectangular top portion having a vertical rear wall, a vertical front wall, a reflective horizontal top wall, a top front wall radiused transition portion forming an internal rectangular solid sight bead within the rectangular top portion, adapted to be placed on the target when viewed through the vertical rear wall, a vertical reflective right side wall and a vertical reflective left side wall;

b) reflective right and left side shoulders extending outwardly and downwardly from the side walls transitioning into reflective lower vertical side portions extending vertically and downward from the shoulders; and c) a lower most mounting base adapted to affix the front sight to the gun.

11. The translucent reflective hand gun sight of claim 10, further comprising a rear sight with a three sided notch for aligning the front sight therein.

12. The translucent reflective hand gun sight of claim 10, where in the gun sight is made from acrylic or polycarbonate.

* * * * *